US008166716B2

(12) United States Patent
Macdonald et al.

(10) Patent No.: US 8,166,716 B2
(45) Date of Patent: May 1, 2012

(54) DRY JOINT WALL PANEL ATTACHMENT SYSTEM

(76) Inventors: Robert B. Macdonald, London (CA); Philip A. Macdonald, London (CA)

( * ) Notice: Subject to any disclaimer, the term of this patent is extended or adjusted under 35 U.S.C. 154(b) by 166 days.

(21) Appl. No.: 12/829,503

(22) Filed: Jul. 2, 2010

(65) Prior Publication Data

US 2010/0263314 A1 Oct. 21, 2010

Related U.S. Application Data

(63) Continuation-in-part of application No. 11/273,303, filed on Nov. 14, 2005, now abandoned.

(51) Int. Cl.
*E04H 1/00* (2006.01)

(52) U.S. Cl. ..... 52/235; 52/512

(58) Field of Classification Search ..... 52/235, 52/312, 508, 509, 511, 512, 713, 764
See application file for complete search history.

(56) References Cited

U.S. PATENT DOCUMENTS

| | | | | |
|---|---|---|---|---|
| 4,344,267 | A | 8/1982 | Sukolics | |
| 4,439,960 | A | 4/1984 | Jenkins | |
| 4,999,960 | A | 3/1991 | Herwegh et al. | |
| 5,067,293 | A | 11/1991 | Reynolds | |
| 5,170,602 | A * | 12/1992 | Ribic | 52/171.3 |
| 5,220,759 | A | 6/1993 | Hossli | |
| 5,226,274 | A | 7/1993 | Sommerstein | |
| 5,239,798 | A | 8/1993 | Saito | |
| 5,263,292 | A | 11/1993 | Holland et al. | |
| 5,301,484 | A | 4/1994 | Jansson | |
| 5,379,561 | A | 1/1995 | Saito | |
| 5,522,193 | A | 6/1996 | Sommerstein | |
| 5,544,461 | A * | 8/1996 | Sommerstein | 52/235 |
| 5,809,729 | A | 9/1998 | Mitchell | |
| 5,893,245 | A * | 4/1999 | Sekiguchi et al. | 52/235 |
| 6,035,598 | A | 3/2000 | Sukolics et al. | |
| 6,065,259 | A | 5/2000 | Clear | |
| 6,138,419 | A * | 10/2000 | Sekiguchi et al. | 52/235 |
| 6,427,408 | B1 | 8/2002 | Krieger | |
| 6,484,465 | B2 | 11/2002 | Higgins | |
| 6,748,709 | B1 | 6/2004 | Sherman et al. | |
| 7,096,629 | B1 | 8/2006 | Cox | |
| D619,880 | S | 7/2010 | Macdonald et al. | |
| 7,752,818 | B1 | 7/2010 | Roegge | |
| 2002/0124514 | A1 * | 9/2002 | Higgins | 52/506.06 |
| 2005/0060950 | A1 | 3/2005 | Hauschildt et al. | |
| 2006/0179744 | A1 * | 8/2006 | Lynch et al. | 52/235 |
| 2007/0119105 | A1 | 5/2007 | Macdonald et al. | |
| 2009/0241444 | A1 * | 10/2009 | Griffiths | 52/235 |
| 2010/0186343 | A1 | 7/2010 | Macdonald et al. | |

OTHER PUBLICATIONS

Notification concerning transmittal International Preliminary Report on Patentability dated May 22, 2008 (1 page).
International Preliminary Report on Patentability dated May 14, 2008 (1 page).
Written Opinion of the International Searching Authority dated Jan. 2, 2007 (5 pages).

(Continued)

*Primary Examiner* — Branon Painter
(74) *Attorney, Agent, or Firm* — Peter L. Brewer; Baker, Donelson, Bearman, Caldwell & Berkowitz PC

(57) ABSTRACT

A dry joint wall panel attachment system is provided. The system uses interlocking components to attach aluminum (or other) wall panels to an exterior wall. The system is held together non-adhesively.

14 Claims, 8 Drawing Sheets

OTHER PUBLICATIONS

Ashtech Rainscreen Cladding System Brochure (Apr. 2005) (retrieved on-line on Aug. 10, 2009 from www.ashlandlacy.com/ashtech/index.aspx) (16 pages).
CGL Rainscreen System (date unknown) (retrieved on-line on Aug. 10, 2009 from www.cglsystems.co.uk/products/metal-facade-systems.htm) (1 page).
Northclad Rainscreen Solutions manual (Copyright 2009) (21 pages).
Northclad Rainscreen Solutions ACM Series Details (Copyright 2010) (retrieved on-line on Sep. 28, 2010 from http://northclad.com/products/acm/details/) (5 pages).
Peterson Aluminum Corporation technical drawings (2008-2009) (retrieved on-line on Sep. 28, 2010 from http://www.pac-clad.com/products/wall-soffit-systems/composite-wall-panels/) (2 pages).
Keith Panel Systems, System Details (believed to be dated Sep. 2008) (retrieved on-line in about Mar. 2010 from http:/www.keithpanel.com/files/KPSSSystemA_4mm.pdf; attention is directed to the horizontal joint on p. 6 and the vertical joint on p. 7) (19 pages).
Doralco: Architectural Metal Solutions (Copyright 2009) (retrieved on-line in about Mar. 2010 from http://www.doralco.com/imgs/07 42 43 Rainscreen_Composite_Panel_%20Details.pdf) (38 pages).
Sobotec Ltd: Architectural Wall Systems, Products, SL-2000 Dry Joint Filler System (Apr. 2004) (retrieved on-line from http://www.sobotec.com/SL2000.htm) (1 page).
Office Action dated Jan. 14, 2010 in related U.S. Appl. No. 11/273,303.
Notice of Allowance dated Jan. 21, 2010 in related U.S. Appl. No. 29/350,477 (along with Notice of Allowability) (9 pages).
Northclad Rainscreen Solutions ACM Vertical JointDetails (Copyright 2010) (retrieved on-line on Sep. 28, 2010 from http://northclad.com/files/details/acm/pdf/northclad_acm-b.pdf#view=FitH,top) (1 page).
Reynobond ACM Wall Panels brochure (Copyright 2008) (retrieved on-line on Sep. 28,2010 from http://www.alcoa.com/aap/north_america/catalog/pdf/brochures/Reynobond_CID.pdf) (4 pages).
Electronic correspondence between Brian Elbert of Northshore Sheet Metal and Dennis McKellar of Alcotex (4 pages).
Citadel Envelope 2000 Composite Wall Panel Attachment System (Copyright 2003) (from Citadel Architectural Products, Inc., showing another example of assymmetrical attachment components) (3 pages).

* cited by examiner

DRY JOINT WALL PANEL ATTACHMENT SYSTEM

STATEMENT OF RELATED APPLICATIONS

This continuation-in-part patent application claims the benefit of U.S. patent application Ser. No. 11/273,303 which was filed on Nov. 14, 2005 now abandoned . That application is titled "Dry Joint Aluminum Wall Panel Attachment System," and was published as U.S. Patent Publ. No. 2007/0119105. The application is incorporated herein in its entirety by reference.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. The Background section should be read in this light, and not necessarily as admissions of prior art.

1. Field of the Invention

The present disclosure relates to wall panel attachment systems. More particularly, the present disclosure pertains to methods of attaching wall panels to exterior wall surfaces.

2. Discussion of Technology

There are various problems with known aluminum wall panel attachment systems. Conventionally, such systems have relied upon adhesive or caulk to "seal" the aluminum panel from the elements. However, under exposure to heat and cold and moisture, the adhesive or caulk breaks down. This, in turn, compromises the stability of the system and creates an undesirable appearance. Even when such a seal is functional, there may be undesirable effects on the aluminum panels as the interior environment can trap heat which affects the panels, creating "oil-canning" or popping in response to the pressure differential. In spite of such seals, such systems can also trap moisture in the wall cavity, which results in oxidation of parts and staining or deterioration of exterior wall surfaces.

More recently, systems have been developed according to the "rainscreen principle." This means that the wall cavity is vented, resulting in a temperature and pressure equalized system with moisture drainage. However, such systems can be difficult to install, relying on many components to be milled or adapted on-site, and requiring excessive labour costs and specialty materials. A need exists for an improved wall panel attachment system which permits the ingress and egress of moisture behind the panels. Further, a need exists for an attachment system in which the wall panels can be attached to a wall in any sequence.

SUMMARY OF THE INVENTION

A dry joint wall panel attachment system for attaching wall panels to an exterior building wall is provided herein. In one aspect, the attachment system first includes a plurality of wall panels. Each wall panel has an exterior flat surface and at least two side surfaces bent generally perpendicularly to the exterior flat surface. In this way, a hollow interior portion is defined. Preferably, each wall panel comprises an aluminum composite material.

The attachment system also includes a plurality of bracket assemblies. Each bracket assembly is configured to be fastened to the exterior wall. In one aspect, each bracket assembly comprises two back-to-back L angle brackets fastened to each other to form a generally Z shaped assembly. A first end is for attachment to the wall, and a second end is for fastening to an attachment clip. Preferably, the bracket assemblies are fabricated from steel for strength.

The attachment system also has a plurality of attachment clips. Each clip is preferably fabricated from aluminum or an aluminum composite material ("ACM"), and is configured to be fastened to a respective bracket assembly by a fastener. Preferably, each fastener comprises a threaded fastener. The attachment clips carry the dead loads of the wall panels.

Each attachment clip has a central fastening surface fastened to the bracket assembly. Each attachment clip further has a pair of integrally formed wing members. Each wing member extends outwardly from the central fastening surface in a substantially symmetrical manner. Preferably, isolation tape is applied between the attachment clips and the respective bracket assemblies.

The attachment system also includes a plurality of panel perimeter strips. Preferably, each panel perimeter strip is fabricated from aluminum or an ACM. Each panel perimeter strip is configured to be fastened to one side surface of a respective wall panel. Further, each panel perimeter strip comprises:

- a generally C-shaped member configured to reside inside of and extend along an inside portion of a side surface of a respective wall panel, and
- a receiving member integrally attached to the C-shaped member configured to extend beyond the side surface of a wall panel and provide a slot adapted to engage and interlock one of the wing members of the attachment clip, thus connecting a respective wall panel to the attachment clip and thereby to the wall;

The attachment system also includes one or more rivets. The rivets are placed along the side surface of the wall panels to connect the side surface of a respective wall panel to a receiving member of a panel perimeter strip.

The attachment system may optionally include panel stiffeners. The panel stiffeners are positioned inside the hollow interior portion of the respective wall panels to reinforce the exterior surfaces of the wall panels and to prevent deforming or popping of the wall panels.

The attachment system further includes a plurality of infill strips. Each infill strip is preferably fabricated from a substantially rigid material comprising aluminum, polyethylene, or combinations thereof. Each of the infill strips is non-sealingly disposed within respective slots of adjoining panel perimeter strips.

The infill strips are placed between a corresponding attachment clip and the one or more rivets so as to cover the fastener. In one aspect, each infill strip is engaged with the slot of a panel perimeter strip prior to installing an adjacent wall panel. Alternatively, each infill strip may be introduced to the slots of two adjacent panel perimeter strips after two adjacent wall panels have been installed.

The attachment system is held together non-adhesively. Further, each wall panel is ventilated at least partially through the one or more rivets to permit ingress and egress of air and moisture to provide a pressure-balanced and moisture-drained interior environment. In addition, the attachment system is configured to allow panels to be secured to respective panel perimeter strips in any sequence.

Additional wall panels may be attached to the exterior wall using additional bracket assemblies, attachment clips and panel perimeter strips.

BRIEF DESCRIPTION OF THE FIGURES

So that the manner in which the above recited features of the present invention can be better understood, certain drawings are appended hereto. It is to be noted, however, that the appended drawings illustrate only selected embodiments of the inventions and are therefore not to be considered limiting of scope, for the inventions may admit to other equally effective embodiments and applications.

DETAILED DESCRIPTION

A wall panel attachment system is provided herein. The wall panel attachment system employs an extruded aluminum (or other metal) attachment system for fastening a plurality of panels to a building surface. The system's strength is enhanced by the use of an extruded perimeter frame design which carries the dead load for the various panels.

Figure 1:
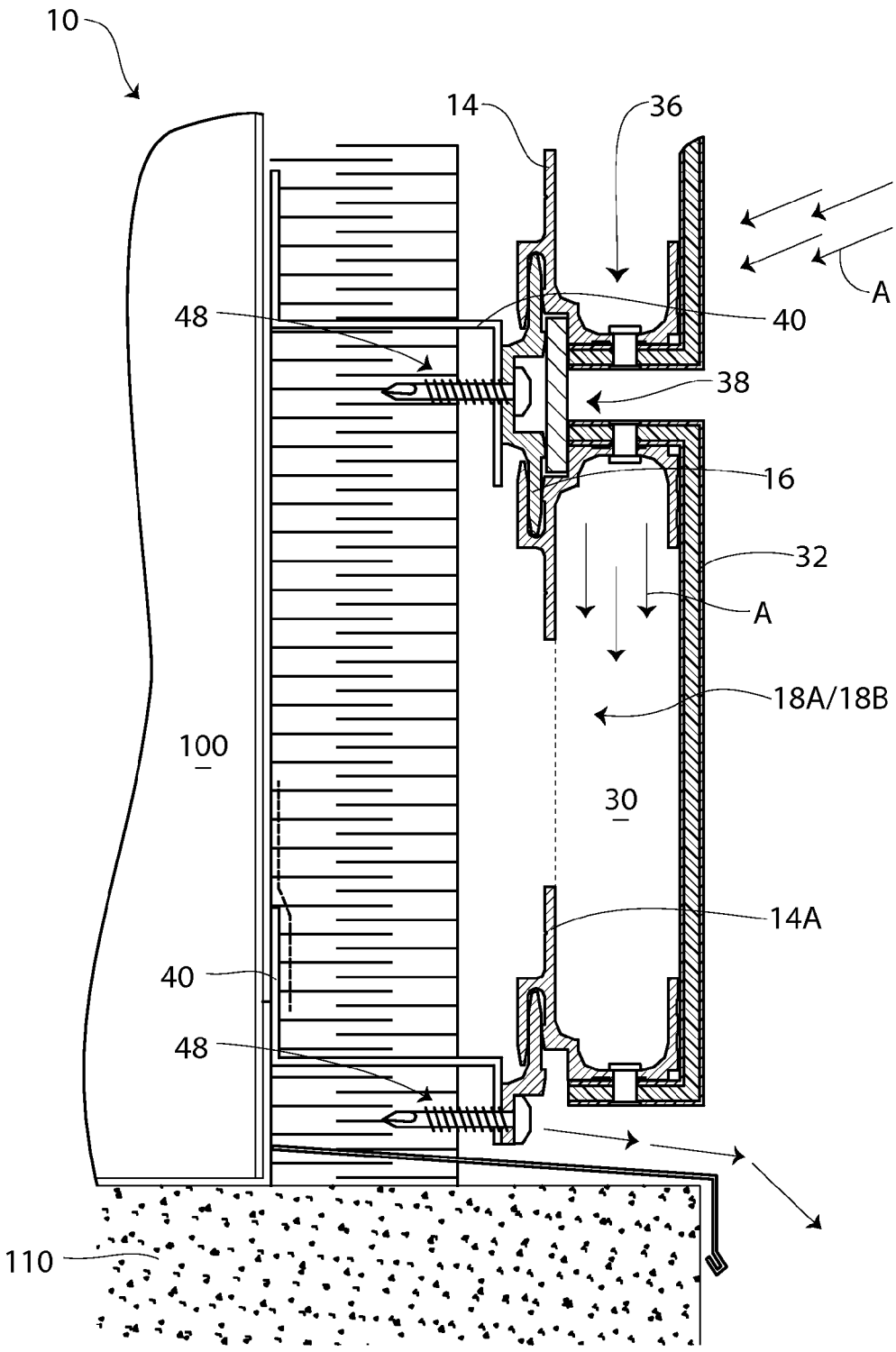
FIG. 1 shows a cut-through view of a dry joint aluminum wall panel attachment system, according to a preferred embodiment.

FIG. 1 presents a partial cut-through view of a dry joint wall panel attachment system 10, according to one embodiment. The system 10 is designed to be in accordance with the rainscreen principle. This means that the system 10 is designed so that a wall cavity formed under the individual panels is vented, resulting in a pressure equalized system. Controlled moisture drainage within the system, coupled with this equalized pressure, contributes to effective, maintenance-free construction. The flow of air through a wall panel 32 and into a hollow interior 30 is shown at arrows "A."

The attachment system 10 may be fabricated through an extrusion process. The extrusion process begins with an aluminum billet, which is the material from which the profiles are preferably extruded. The billet must be softened by heat prior to the extrusion process. The heated billet is placed into an extrusion press, which represents a powerful hydraulic device wherein a ram pushes a dummy block. The dummy block, in turn, forces the softened metal through a precision opening, known as a die. The die produces the required shapes.

The extruded parts are cut to specific lengths. The extruded parts may have a mill or an anodized finish. It is, of course, understood that the system 10 is not limited by the specific extrusion process or other method by which the component parts may be manufactured.

Figure 2:
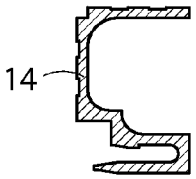
FIG. 2 is a cross-sectional view of a panel perimeter strip used in the attachment system, in one embodiment.
Figure 10:
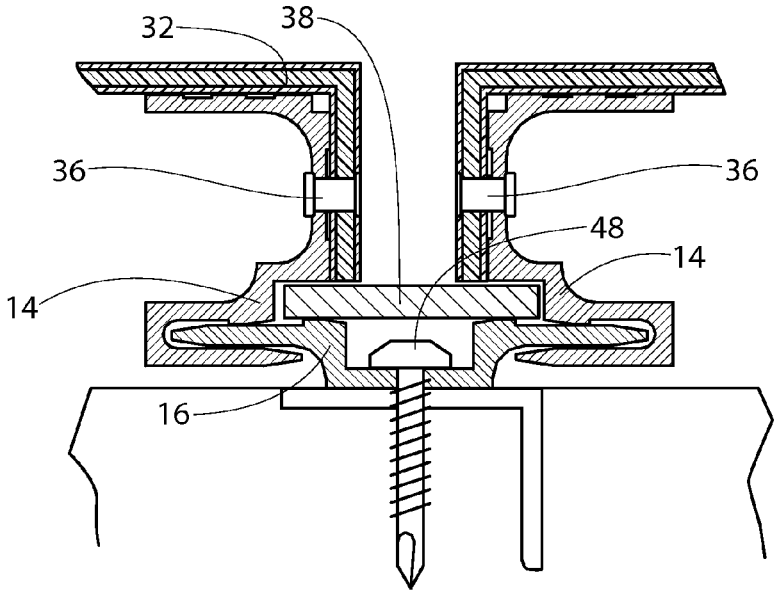
FIG. 10 shows a detailed view of the preferred placement of the infill strip in the attachment system.

The system 10 includes a panel perimeter strip. FIG. 2 provides a cross-sectional view of an illustrative panel perimeter strip 14. FIG. 10 provides a cross-sectional view of a pair of panel perimeter strips 14. In FIG. 10, the panel perimeter strips 14 have been connected to corners of wall panels 32. Connection is by means of counter-sunk rivets 36. FIG. 10 will be discussed in further detail below.

Referring back to FIG. 1, three panel perimeter strips are seen, with one being marked as 14A. The panel perimeter strips 14/14A are attached to side surfaces of wall panels 32. The wall panels 32 are preferably fabricated from an aluminum composite material, or ACM. Rivets (not numbered) are also shown in FIG. 1, connecting the panel perimeter strips to the panels 32.

Figure 3:
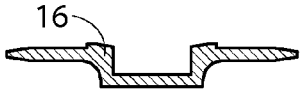
FIG. 3 is a cross-sectional view of an attachment clip used in the attachment system, in one embodiment.

The system 10 also includes an attachment clip. FIG. 3 provides a cross-sectional view of an illustrative attachment clip 16. The attachment clip 16 has a central fastening surface, and a pair of integrally formed wing members. Each wing member extends outwardly from the central fastening surface in a substantially symmetrical manner.

FIG. 10 provides another cross-sectional view of an attachment clip 16. In FIG. 10, each wing member of the attachment clip 16 is received by an opposing panel perimeter strip 14. Thus, the panel perimeter strips 14 are designed to fit together with the wing members of the attachment clips 16. The custom-designed extrusion allows for maximum attachment area without foregoing structural integrity.

The attachment clip 16 is used on-site to attach the panel perimeter strips 14 to a building. An exterior building surface is shown in FIG. 1 at 100. The exterior building surface 100 is above a building foundation or ground surface 110.

Figure 12:
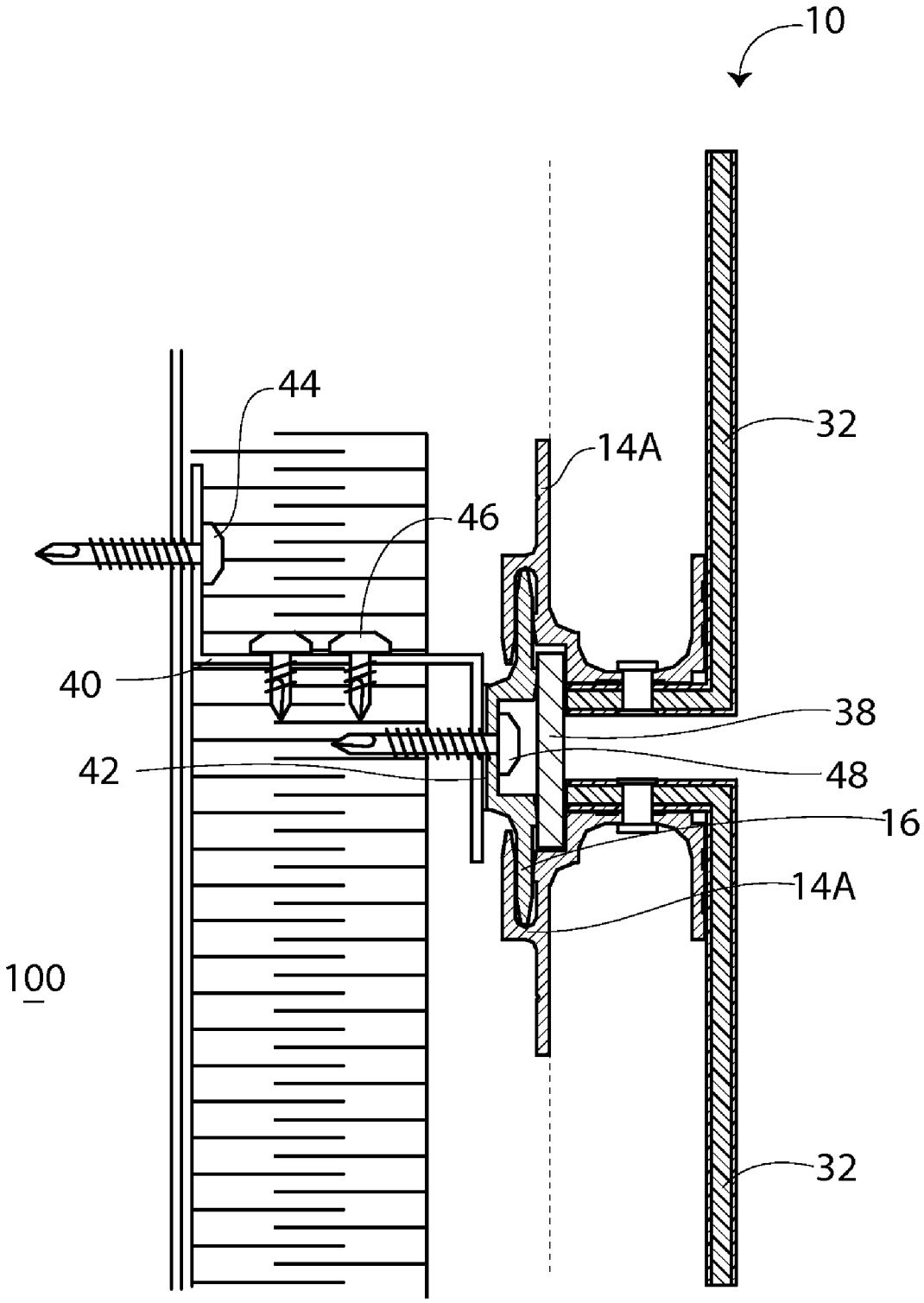
FIG. 12 shows a detailed view of the complete attachment system with sub-framing, in one embodiment.

To install the panel system 10, sub-framing is constructed. Preferably, the sub-framing comprises two back-to-back galvanized steel "L" angles. FIG. 12 is an enlarged cross-sectional view showing the system 10 of FIG. 1. In FIG. 12, two "L" angles are seen at 40. The L-angles 40 allow the installer to level the substrate in all three axes before installation of panels 32. Preferably, stainless steel screws 44 are used to connect the L-angles 40 to the building surface 100. Further, the L-angles 40 themselves may be connected through stainless steel screws 46.

Figure 11:
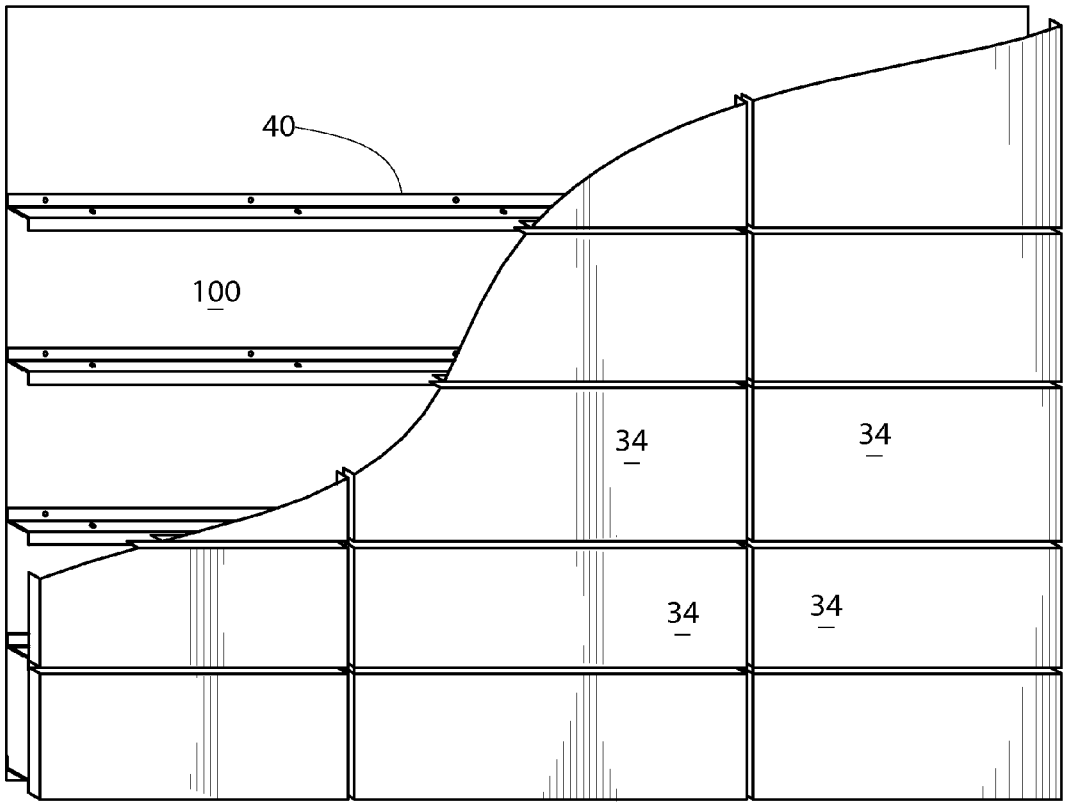
FIG. 11 shows an elevational view of sub-framing used for mounting the ACM panels in the present system, in one arrangement.

The sub-framing is typically installed horizontally at each horizontal joint. FIG. 11 shows a cut-away elevational view of the sub-framing, or L-angles 40, as installed on an exterior building surface 100. It can be seen that a series of finished ACM panel assemblies 34 have been mounted onto the exterior building surface 100. Preferably, panel assemblies 34 are mounted from the bottom of the exterior building surface 100, and moves up. In this way, the installer may make sure that each row is level relative to the previous row installed. However, it is observed here that the finished panel assemblies 34 may be installed in any sequence.

This aspect of the inventions deserves further discussion. As can be seen in FIG. 11, the L-angle brackets 40 have been placed along the exterior building surface 100 in horizontal rows. The finished panel assemblies 34 may be secured to the brackets 40 from left-to-right, from right-to-left, or even out of order provided the correct spacing is maintained. Similarly, the L-angle brackets 40 may be placed along the exterior building surface 100 in vertical rows. The finished panel assemblies 34 may then be secured to the brackets 40 from bottom-to-top, from top-to-bottom, or out of order provided the correct spacing is maintained.

Referring back to FIG. 12, a layer of isolation tape 42 may be applied to the back of the aluminum attachment clips 16. This prevents direct contact between the galvanized steel sub-framing (L-angles 40) and the corresponding aluminum attachment clip 14. Thus, in turn, prevents galvanic action (electrolytic decay of the aluminum) over time. Preferably, stainless steel self-drilling screws 48 are used to fasten the aluminum attachment clips 16 to steel sub framing 40. After determining a logical order of installation, each panel 32 is be plumbed and leveled to ensure a tight and concise fit from panel to panel.

Figure 4:
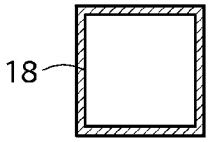
FIG. 4 is a cross-sectional view of a panel stiffener optionally used in the attachment system, in one embodiment.

The individual panels 32 may optionally be supported by a panel stiffener. FIG. 4 provides a cross-sectional view of a panel stiffener 18, in one embodiment. In this embodiment, the panel stiffener 18 comprises a hollow tube.

Such a panel stiffener 18 is desirable on large-sized panels. The panel stiffeners 18 may be used to prevent the popping or "oil canning" of the finished panel assemblies 34. As the individual panels 32 heat up, the panels 32 may expand and make a popping sound. The stiffeners 18 reinforce the panels 32 to reduce this effect.

Figure 18:
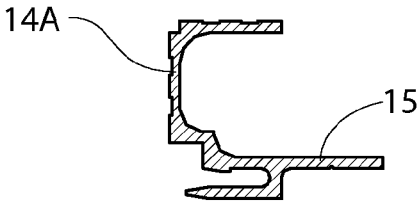
FIG. 18 shows a cross-sectional view of an alternative panel perimeter strip.
Figure 19:
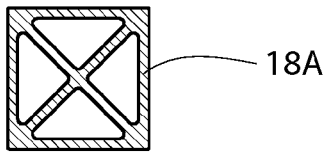
FIGS. 19 and 20 show cross-sectional views of two versions of an alternative panel stiffener.
Figure 20:
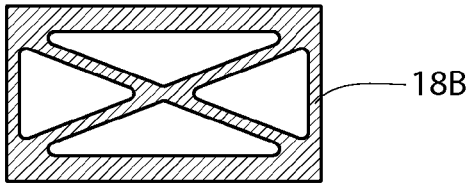

FIGS. 19 and 20 provide cross-sectional views of panel stiffeners 18A, 18B, in respective alternate embodiments. In these arrangements, the panel stiffeners 18A, 18B are internally reinforced. This provides greater stability between the exterior building surface 100 and the panel assemblies 34.

Where panel stiffeners 18, 18A, 18B are used, the panel perimeter strip 14 may be adapted to better locate and secure the stiffener component. A panel perimeter strip 14A having a profile as shown in FIG. 18 may be advantageous for this purpose. An extended interior lip 15 of the panel perimeter strip 14A operates to secure the panel stiffener component.

Panel stiffeners may be provided in different sizes depending on the wind pressures to which the panels 34 will be exposed. A larger width panel stiffener 18B may be advantageous where there are greater wind loads on the attachment system 10 or if less deflection on the individual panels 34 is desired. It will be appreciated that the construction of the panels 32 themselves also provides a basic level of rigidity, and stiffeners are not necessarily required.

Figure 9:
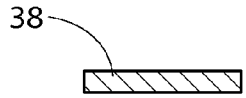
FIG. 9 shows a cross-sectional view of an infill strip used in the attachment system.

The attachment system 10 also includes an infill strip. An infill strip is shown in the cross-sectional views of FIGS. 1, 10, and 12 at 38. An infill strip 38 is also shown in cross-sectional isolation in FIG. 9. The infill strip is preferably cut to a width of approximately 1-¼" (32 mm) for a ½" (13 mm) joint. The infill strip 38 replaces the conventional caulk joint, giving the panel system a clean, maintenance free appearance. The infill strip 38 also is used to hide the fasteners 48 for the attachment clip 16.

Each attachment clips 16 is designed so as to interlock with a pair of panel perimeter strips 14 while holding an infill strip 38 securely in place.

Figure 5:
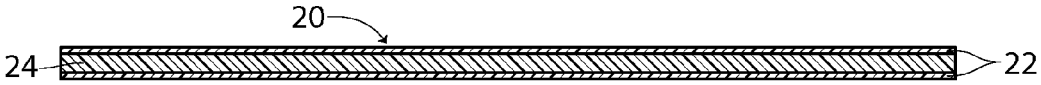
FIG. 5 shows a cross-sectional view of aluminum composite material (ACM) as may be used in the wall panels.
Figure 6:
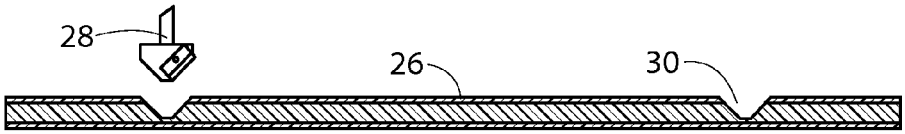
FIGS. 6, 7, 8 show progressive steps in the formation of an ACM panel for use in the present system, in one embodiment.
Figure 7:
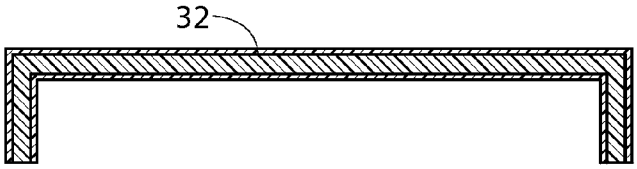

Both the infill strips 38 and the panels 32 are preferably fabricated from an aluminum composite material ("ACM"). FIGS. 5 through 7 present illustrative cross-sectional views of a panel 32 undergoing fabrication. The panel 32 is fabricated from several layers for form an ACM 20.

As shown in FIG. 5, the ACM 20 consists of a core of low density polyethylene 24 sandwiched between two sheets of aluminum 22 (each approximately 0.5 mm thick). The finish face of the aluminum sheets 22 is coated with a polyvinylidene fluoride coating. The inner aluminum layer is typically coated with chrome or polyester coatings. The standard thickness of the panel 32 is 5⁄32" (4 mm) but thickness may range from ⅛" (3 mm) to ¼" (6 mm), depending on customer preference or structural requirements.

A finished ACM panel 32 may be fabricated from a flat sheet of ACM 26 using different types of router and cutting bits 28 (seen in FIG. 6). After the sheet of ACM 26 has been cut and routed, the sheet 26 is then bent along the router lines to form the finished panel 32 (seen in FIG. 7). The newly-shaped panel 32 is then assembled with the panel perimeter strip 14 using a panel rivet 36 to complete the finished panel assembly. A standard panel rivet for this application may be 3⁄16" diameter.

Figure 8:
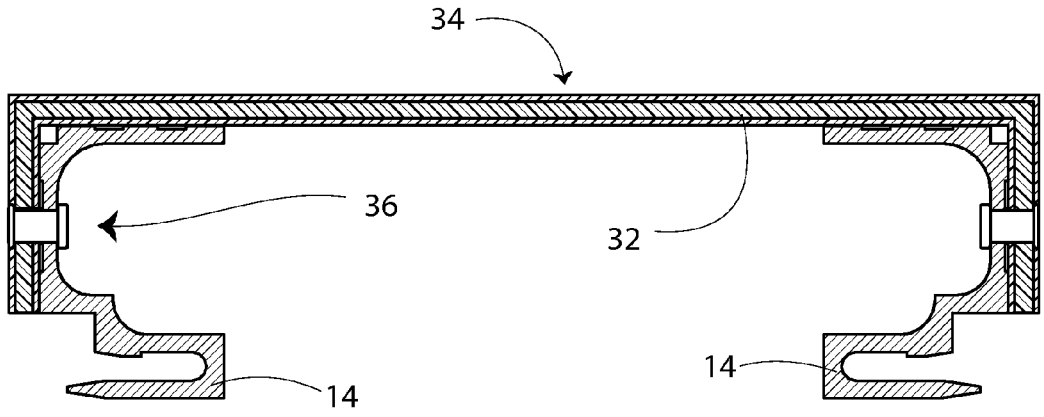

FIG. 8 shows a finished panel assembly 34. Panel perimeter strips 14 are shown supporting a panel 32.

There are various methods to accomplish the routing and cutting process:

Method 1

Handheld router (not shown): A handheld router is used more often when reworking a panel to a different size. This method requires the simplest tool set up, but is the most labor-intensive method of fabrication due to the lengthy time for setup and layout of each different panel.

Method 2

Vertical table saw (not shown): A vertical table saw can also be used, both to cut and rout the panels. Custom "V" routing blades can be purchased to rout the panels. Panel design is limited using the vertical table saw in itself. Using it in combination with the hand held router has its advantages, but it is still a costly way to manufacture panels.

Method 3

CNC-Machine (not shown): The computer numerically controlled (CNC) machine is a complete and concise way to manufacture panels. Once the panel has been designed by a CAD operator it is then sent directly to the machine. This machine has been found to be very useful and economical for manufacturing panels. This is the applicants' preferred method for cutting and routing panels.

FIGS. 13 through 16 demonstrate the installation of an infill strip 38 into an attachment system 10. The infill strips 38 are preferably shipped to a construction site in long lengths, and are cut to fit on-site. The strips 38 may have a protective plastic coating, which is then removed from the face of the infill strips 38 before installation.

Figure 13:
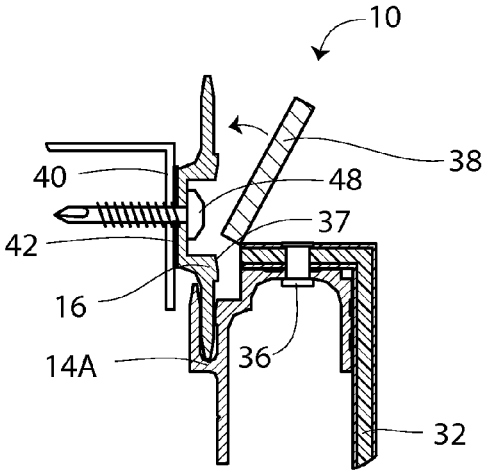
FIGS. 13, 14 and 15 show progressive steps in the installation of infill strips in the present system, according to a first method.
Figure 14:
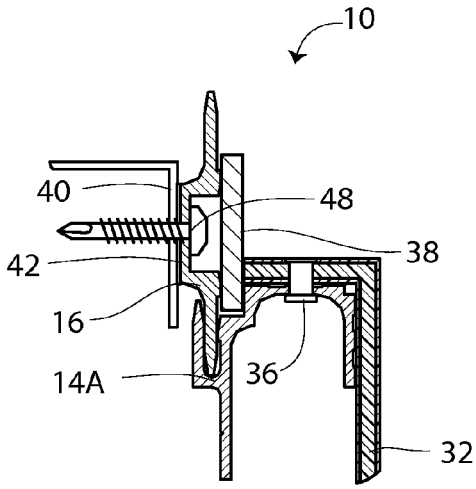
Figure 15:
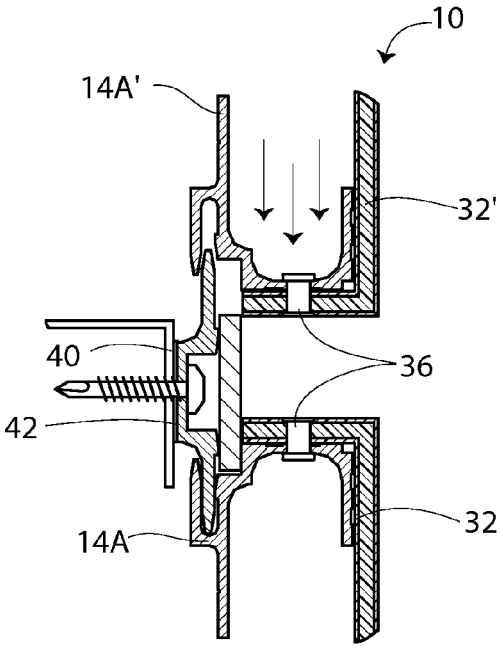

The infill strips 38 may be installed one of two ways:

First, as shown in FIGS. 13 through 15, individual infill strips 38 may be slipped into a slot 37 before the adjacent panel is installed. This is of benefit when the edge of the joint is not accessible, or when the infill strip 38 has a curve or bend in it. The infill strip 38 is fitted into the space between the panel 32 and the attachment clips 14 as illustrated in FIG. 13 and FIG. 14. Then, an adjacent panel 32' is installed so that the infill strip 38 and attachment clip 16 engage into the slots 37 in the panel edge at the perimeter strip 14A' (FIG. 15).

Figure 16:
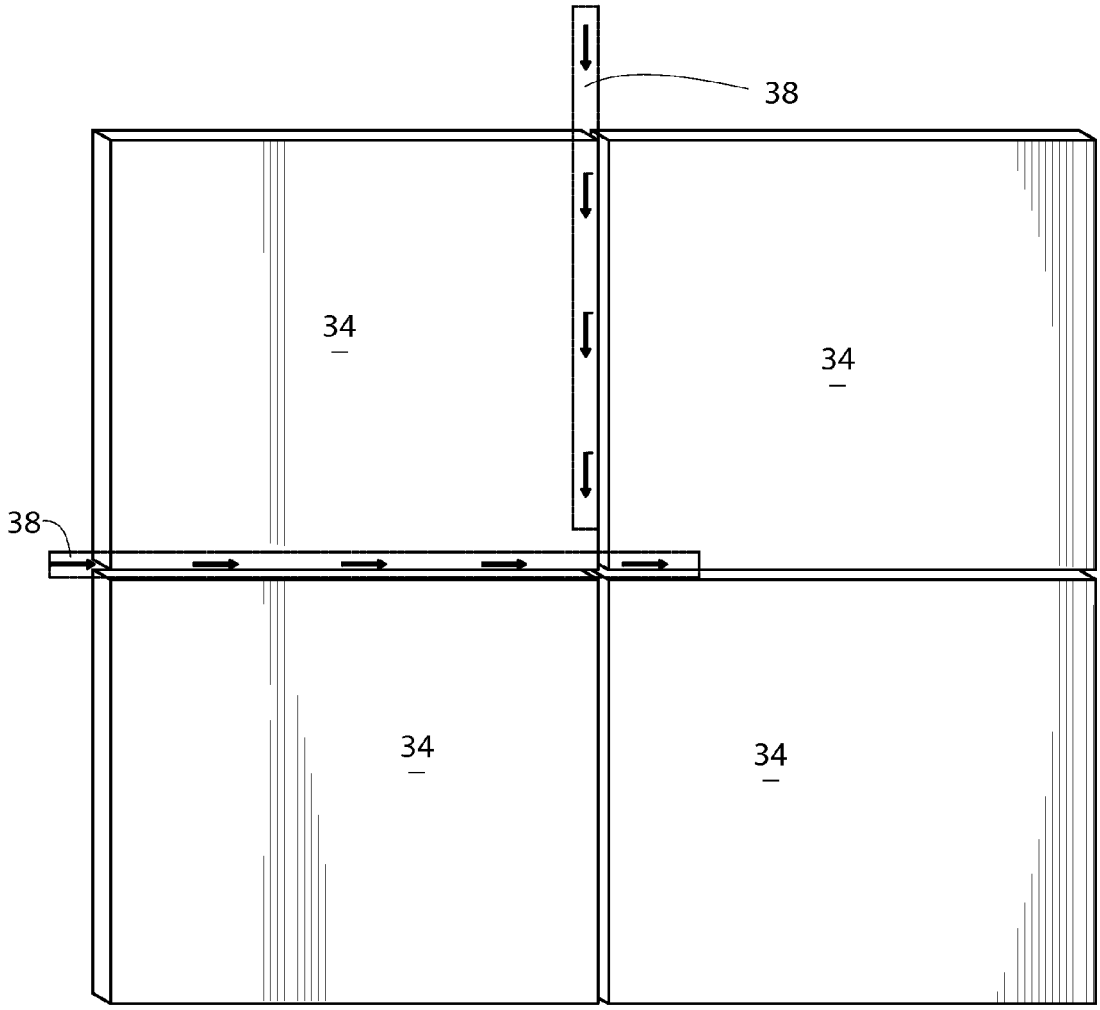
FIG. 16 shows a view of the installation of lengths of infill strip in the present system, according to a second method.

Second, and as an alternative method of installation, the installer can slide the infill strip 38 in from the end. This is shown in FIG. 16. This allows for a simplified installation of the finished panels 34. The infill strips 38 are not installed until an area is complete. This means that panel assemblies 34 can be adjusted for straightness and position even after adjacent panels have been installed. The difficulty with this method is that the end of the joint will not always be accessible (i.e. wall or window frame) and the infill strip 38 may have a tendency to catch on the attachment clips 16 as it is being slid into the joint. To aid in the sliding of the strips 38, a tool may be used to pull the leading edge of the strips 38 over the clips (not shown in FIG. 16).

Figure 17:
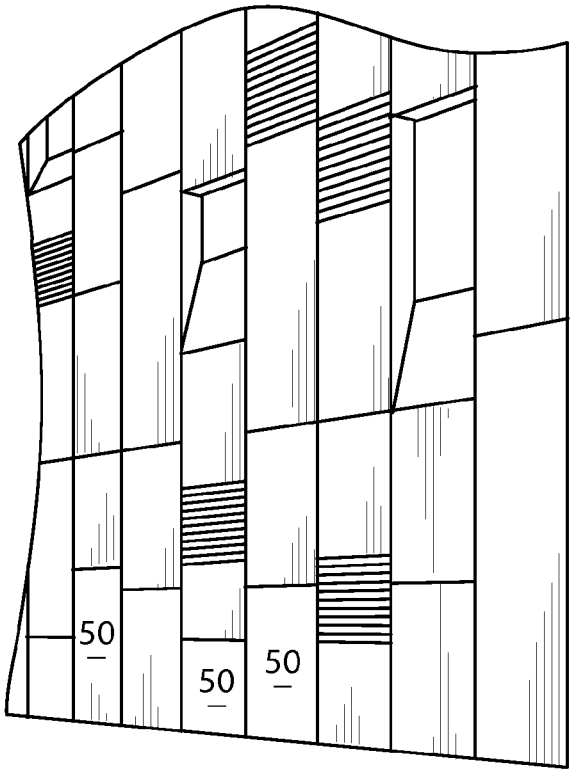
FIG. 17 shows a view of a finished wall paneled exterior.

FIG. 17 presents a perspective view of a finished wall panel exterior. The finish faces of the panels 32 may have a protective film 50 to protect against minor abrasions that may occur during handling and installation. The protective film 50 may be peeled back from the returns of the panels 32 before installing. To keep the panels 32 clean and free of construction debris, generally the protective plastic film 50 is only removed from the faces of the panels once the landscaping has been completed.

As can be seen, a dry joint aluminum wall panel attachment system 10 for attaching wall panels to an exterior building wall is provided. The attachment system includes a plurality of individual wall panels 32. Each wall panel has an exterior flat surface and four side surfaces. At least two of the side surfaces are bent generally perpendicularly to the exterior flat surface. In this way, a hollow interior portion 30 is defined.

The attachment system 10 also includes a plurality of bracket assemblies. Each bracket assembly is configured to be fastened to the exterior wall 100. In one aspect, each bracket assembly comprises two back-to-back L-angle brackets 40 fastened to each other via connectors 46 to form a generally Z shaped assembly. A first end is for attachment to the exterior wall surface 100, and a second end is for fastening to an attachment clip 16. Preferably, the bracket assemblies are fabricated from steel for strength.

The attachment system 10 also has a plurality of attachment clips 16. Each clip 16 is preferably fabricated from aluminum or an aluminum composite material ("ACM"), and is configured to be fastened to a respective bracket assembly by a fastener 48. Preferably, each fastener 48 comprises a threaded fastener. The attachment clips 16 carry the dead load of the wall panels 32.

Each attachment clip 16 has a pair of integrally formed wing members. Each wing member extends outwardly from the central fastening surface in a substantially symmetrical manner. Preferably, isolation tape 42 is applied between the attachment clips 16 and the respective bracket assemblies.

The attachment system 10 also includes a plurality of panel perimeter strips 14. Preferably, each panel perimeter strip 14 is fabricated from aluminum or an ACM. Each panel perimeter strip 14 is configured to be fastened to one side surface of a respective wall panel 32. Further, each panel perimeter strip 14 comprises:

- a generally C-shaped member configured to reside inside of and extend along an inside portion of a side surface of a respective wall panel 32, and
- a receiving member integrally attached to the C-shaped member configured to extend beyond the side surface of a wall panel 32 and provide a slot 37 adapted to engage and interlock one of the wing members of the attachment clip 16, thus operatively connecting a respective wall panel 32 to the attachment clip 16 and thereby to the wall 100.

The attachment system 10 also rivets 36. The rivets 36 are placed along the side surface of the wall panels 32 to connect the side surface of a respective wall panel 32 to a receiving member of a panel perimeter strip 14.

The attachment system 10 further includes a plurality of infill strips 38. Each infill strip 38 is preferably fabricated from a substantially rigid material comprising aluminum, polyethylene, or combinations thereof. Each of the infill strips 38 is non-sealingly disposed within respective slots 37 of adjoining panel perimeter strips 14.

The infill strips 38 are placed between a corresponding attachment clip 16 and the one or more rivets 36 so as to cover the fasteners 48. In one aspect, each infill strip 38 is engaged with the slot 37 of a panel perimeter strip prior to installing an adjacent wall panel 32. Alternatively, each infill strip 38 may be introduced to the slots 37 of two adjacent panel perimeter strips 32 after two adjacent wall panel assemblies 34 have been installed.

The attachment system 10 is held together non-adhesively. In addition, the attachment system 10 is configured to allow panel assemblies 34 to be secured to respective panel perimeter strips 14 in any sequence.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What is claimed is:

1. A dry joint wall panel attachment system for attaching multiple wall panels to an exterior building wall, each wall panel having a dead load, and the system comprising:

- a plurality of wall panels, each wall panel having an exterior flat surface and at least two side surfaces bent generally perpendicularly to the exterior flat surface and defining a hollow interior portion;
- a plurality of bracket assemblies configured to be fastened to the exterior wall;
- a plurality of attachment clips configured to be fastened to respective bracket assemblies by a fastener and to carry the dead loads of the respective wall panels, each attachment clip having a central fastening surface fastened to the bracket assembly and a pair of integrally formed wing members, each wing member extending outwardly from the central fastening surface in a substantially symmetrical manner;
- a plurality of panel perimeter strips configured to be fastened to one side surface of a respective wall panel, each panel perimeter strip comprising:
  - a generally C-shaped member configured to reside inside of and extend along an inside portion of a side surface of a respective wall panel, and
  - a receiving member integrally attached to the C-shaped member configured to extend beyond the side surface of a wall panel and provide a slot adapted to engage and interlock one of the wing members of the attachment clip, thus operatively connecting a respective wall panel to the attachment clip and, thereby, to the wall;
- one or more rivets provided along the side surface of respective wall panels to connect the side surface to the receiving member of a respective panel perimeter strip;
- a plurality of infill strips non-sealingly disposed within respective slots of the panel perimeter strips between the corresponding attachment clip and the one or more rivets so as to cover the fastener, each infill strip being fabricated from a substantially rigid material comprising aluminum, polyethylene, or combinations thereof;

wherein:

- the system is held together non-adhesively,
- the system is configured to allow wall panels to be secured to respective panel perimeter strips in any sequence, and
- each wall panel is ventilated at least partially through the one or more rivets to permit ingress and egress of air and moisture to provide a pressure-balanced and moisture-drained interior environment.

2. The attachment system of claim 1, wherein each bracket assembly comprises two back-to-back L angle brackets fastened to each other to form a generally Z shaped assembly, a first end of which is for attachment to the wall and a second end of which is for fastening to an attachment clip.

3. The attachment system of claim 1, wherein each wall panel comprises an aluminum composite material.

4. The attachment system of claim 1, wherein each wall panel comprises an aluminum composite material which is routed and bent to form the exterior and side surfaces.

5. The attachment system of claim 1, wherein each fastener comprises a threaded fastener.

6. The attachment system of claim 1, wherein each panel perimeter strip is pre-assembled to a wall panel before installation to the building wall.

7. The attachment system of claim 1, wherein each infill strip is engaged with the slot of a panel perimeter strip prior to installing an adjacent wall panel.

8. The attachment system of claim 1, wherein each infill strip is introduced to the slots of two adjacent panel perimeter strips after two adjacent wall panels have been installed.

9. The attachment system of claim 1, further comprising:

an isolation tape applied between each attachment clip and a corresponding bracket assembly.

10. The attachment system of claim 1, wherein each attachment clip comprises an aluminum attachment clip.

11. The attachment system of claim 1, wherein each bracket assembly comprises a steel bracket assembly.

12. The attachment system of claim 1, wherein each infill strip comprises a strip of aluminum composite material.

13. The attachment system of claim 1, wherein each panel perimeter strip is fabricated at least partially from aluminum.

14. The attachment system of claim 1, further comprising:

a panel stiffener placed inside a hollow interior portion of each wall panel to reinforce an exterior surface of each wall panel and inhibit deforming or popping of the corresponding wall panel.

* * * * *